US005141821A

United States Patent [19]

Lugscheider et al.

[11] Patent Number: 5,141,821

[45] Date of Patent: Aug. 25, 1992

[54] HIGH TEMPERATURE MCRAL(Y) COMPOSITE MATERIAL CONTAINING CARBIDE PARTICLE INCLUSIONS

[75] Inventors: Erich Lugscheider, Aachen; Heinz Eschnauer, Freigericht; Johannes Wilden, Aachen; Frank Büche, Bad Säckingen; Helmut Meinhardt, Murg-Hänner, all of Fed. Rep. of Germany

[73] Assignee: Hermann C. Starck Berlin GmbH & Co KG, Berlin, Fed. Rep. of Germany

[21] Appl. No.: 529,583

[22] Filed: May 29, 1990

[30] Foreign Application Priority Data

Jun. 6, 1989 [DE] Fed. Rep. of Germany ..... 3918380

[51] Int. Cl.[5] ..... C23C 12/00

[52] U.S. Cl. ..... 428/614; 428/627

[58] Field of Search ..... 428/614; 1/627

[56] References Cited

U.S. PATENT DOCUMENTS

| | | | |
|---|---|---|---|
| 3,802,938 | 4/1974 | Collins et al. | 148/12.7 N |
| 4,275,124 | 6/1981 | McComas et al. | 428/679 |
| 4,656,099 | 4/1987 | Sievers | 428/678 |

FOREIGN PATENT DOCUMENTS

| | | |
|---|---|---|
| 1500780 | 2/1978 | United Kingdom . |
| 2006274 | 5/1979 | United Kingdom . |
| 8201897 | 6/1982 | World Int. Prop. O. . |

*Primary Examiner*—Upendra Roy

*Attorney, Agent, or Firm*—Jerry Cohen; Harvey Kaye

[57] ABSTRACT

MCrAlY composite material with platinum and/or rhodium alloying elements as 5–15 wt. % thereof and containing included particles of carbides vanadium, niobium, tantalum, titanium, zirconium, hafnium, chromium, molybdenum and/or tungsten and/or mixtures thereof, enhancing the corrosion- and wear-resistance of such materials at high temperatures.

2 Claims, No Drawings

HIGH TEMPERATURE MCRAL(Y) COMPOSITE MATERIAL CONTAINING CARBIDE PARTICLE INCLUSIONS

BACKGROUND OF THE INVENTION

The present invention relates to a new corrosion- and wear-resistant high temperature composite material based on an alloy of the MCrAlY type as the matrix metal with platinum and/or rhodium as alloy elements in amounts of 5 to 15 wt. %, a process for the preparation of this high temperature composite material and its use.

In many modern industrial plants, such as e.g. in energy production, waste combustion or coal gasification, components of the plant must be resistant towards corrosion at high temperatures and wear or be substantially protected from these circumstances by suitable coatings.

The use of materials with the general designation MCrAl(Y) alloys (the yttrium component being in some instances, optional) wherein M represents a metal from the group comprising iron, cobalt and nickel or combinations of these elements, is known from the field of gas turbine construction, in particular in aircraft engines. Materials of this type are described in U.S. Pat. Nos. 3,874,901; 3,928,026; 3,542,530; and 3,754,903. Further development of MCrAlY alloys with the aim of increasing the resistance to corrosion has led to alloy types containing noble metals. U.S. Pat. No. 3,918,139 describes an MCrAlY alloy containing 3 to 12 wt. % platinum or rhodium. Platinum-containing coating alloys based on NiCrAl have in the past exhibited an outstanding resistance to corrosion in many cases.

According to U.S. Pat. Nos. 3,879,831 and 4,124,737 it is possible to improve the wear properties of MCrAlY materials by adding inter alia, mechanically resistant substances, such as oxides and nitrides, to the base alloys. It is moreover known from U.S. Pat. No. 4,275,124 that the wear properties of MCrAlY alloys can be increased by carbides formed in situ or by alloyed carbides.

Chromium carbide, $Cr_3C_2$, is mentioned as an additive in U.S. Pat. No. 4,275,090. The addition of TaC to Ni—Cr and Co—Cr materials is also indeed known from U.S. Pat. Nos. 4,117,179 and 4,124,137, but the influence of tantalum on the oxidation corrosion properties is predominantly reported as being negative.

The carbides included in the MCrAlY matrix react to a greater or lesser degree in the matrix under the operating temperatures which occur, because of the physical and chemical properties of this composite system. The rate of reaction increases as the temperature increases, and carbides of the 6th sub-group (e.g. $Cr_3C_2$) are degraded faster at the same temperature than those of the 4th sub-group (e.g. TiC, NbC). Since the efficiency of many plants which operate at high temperatures can be further increased by increasing the temperature, however, materials which are stable at high temperatures and resistant to corrosion and wear are required.

The object of the invention is therefore to improve the stability to high temperatures of the composite materials of an MCrAlY matrix and mechanically resistant substances in order to overcome the disadvantages of the known material combinations. Heat-stable corrosion- and wear-resistant alloys which can be used at temperatures of 600° to 1,100° C. are thus accordingly to be provided.

SUMMARY OF THE INVENTION

It has now been found that these conditions are met by an MCrAl(Y) material (with or without a yttrium content) which, in addition to platinum or rhodium, contains carbides of the 4th and/or 5th and/or 6th subgroup of the periodic table of the elements. It has been found that these additional alloying elements greatly reduce the degradation reactions between the carbides and the matrix, so that carbide particles included in the matrix maintain their wear-inhibiting action for longer. It is also possible to use mixed carbides.

The positive action in this connection which additionally originates from the platinum is, as is known, an improvement in the corrosion properties due to improved adhesion of oxide to the surface. The platinum content of the MCrAlY matrix can be up to 15 wt. %, and the carbide content can vary between 0.01 and 75 wt. %.

This invention thus relates to a corrosion- and wear-resistant high temperature composite material based on an alloy of the type MCrAlY as the matrix metal with platinum and/or rhodium as alloying elements in amounts of 5 to 15 wt. %, and included particles of mechanically resistant substances in the form of carbides of the elements vanadium, niobium, tantalum, titanium, zirconium, hafnium, chromium, molybdenum and/or tungsten and/or mixtures thereof being included in the matrix metal in amounts of 0.01 to 75 wt. %, preferably 5 to 75 wt. %, based on the high temperature composite material.

DETAILED DESCRIPTION OF PREFERRED EMBODIMENTS

In a preferred embodiment, the carbide particle size is less than 50 μm. The carbide particles contained in the material are compact. Corresponding matrix alloys of the type MCrAlY with platinum and/or rhodium additives in powder form as matrix materials for composite materials containing dispersed powders of mechanically resistant substances have not previously been disclosed.

This invention also relates to a process for the preparation of the high temperature composite materials according to the invention. The MCrAlY-mechanically resistant substance alloys can preferably be prepared by suspension atomization, mechanically alloying or mixing of composite powders of MCrAlY, platinum and/or rhodium and mechanically resistant substances, such as carbides of the elements vanadium, niobium, tantalum, titanium, zirconium, hafnium, chromium, molybdenum and/or tungsten and/or mixtures thereof, which contain 5 to 15 wt. % platinum and/or rhodium and 0.01 to 75 wt. %, preferably 5 to 75 wt. %, metal carbide.

The invention relates to the use of the high temperature composite materials for the production of surface protection layers. In this case, the powders are preferably processed to the surface protection layers by surfacing welding or thermal spraying processes, such as plasma spraying, powder plasma surfacing welding, high-speed flame spraying or laser coating.

This invention also relates to the use of the high temperature composite materials according to the invention for the production of compact components, which are obtained by compacting the pulverulent starting substances to give component blanks or components. Abrasion-resistant components which are stable at high temperatures can be produced by compacting processes such as sintering, hot isotactic pressing or injection moulding.

Very dense, firmly adhering composite layers are produced by vacuum plasma spraying. These have been tested for corrosion resistance and adhesion by cycles of heating to 900° C. and cooling to 200° C. The heating, heat treatment and cooling cycle lasted 80 minutes. A nickel-based superalloy was used as the base material.

After 1,000 test cycles (1,333 hours), there were no signs of a loss of the layers—breaks or chips.

A comparison between platinum-free and platinum-containing matrices which include carbides shows that the diffusion-related exchange between the carbide and matrix elements proceeds more slowly in the presence of platinum.

Layers with varying contents of mechanically resistant substances were produced by powder plasma surfacing welding and plasma spraying, and the abrasion-wear properties against SiC discs of grain size 600 as the counter-body were determined with these. All the matrix-mechanically resistant substance combinations showed similar properties which were improved in comparison with the matrix layer containing no mechanically resistant substances in these tests. The addition of 75 vol. % mechanically resistant substance has the effect of a significant reduction in the wear rate, regardless of the type of mechanically resistant substance. The wear is only 55 to 70% of the wear rate of the pure matrix alloy, depending on the type of mechanically resistant substance.

MCrAlY-platinum-mechanically resistant substance composite powders have been processed to compact bodies by hot isotactic pressing (HIP). Evaluation of wear studies confirms the results obtained with the aid of the protective layer.

We claim:

1. Corrosion- and water-resistant high temperature composite suspension-atomized powders comprising an alloy of MCrAl(Y) where M is selected from the group consisting of Fe. Co. Ni and combinations thereof as the matrix material with alloying elements platinum and rhodium in an amount from 5 to 15 wt. %, characterized in that particles of mechanically resistant substances in the form of carbides of elements selected from the group consisting of vanadium, niobium, tantalum, titanium, zirconium, hafnium, chromium, molybdenum and tungsten and mixtures thereof are included in the matrix metal in amounts of 0.01 to 75 wt. %, based on the high temperature composite material.

2. The composite of claim 1 comprising 5–75 w/o of said particle inclusions therein based on the high temperature composite powders.

* * * * *